US008411895B2

(12) United States Patent
Liu et al.

(10) Patent No.: US 8,411,895 B2
(45) Date of Patent: Apr. 2, 2013

(54) BOBBIN AND LOUDSPEAKER USING THE SAME

(75) Inventors: Liang Liu, Beijing (CN); Jia-Ping Wang, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 353 days.

(21) Appl. No.: 12/824,371

(22) Filed: Jun. 28, 2010

(65) Prior Publication Data

US 2010/0329501 A1 Dec. 30, 2010

(30) Foreign Application Priority Data

Jun. 26, 2009 (CN) ..... 2009 1 0108181

(51) Int. Cl.
*H04R 1/22* (2006.01)
*H04R 9/02* (2006.01)

(52) U.S. Cl. ..... 381/407; 381/400; 381/409; 381/410; 977/742; 977/949

(58) Field of Classification Search ..... 381/407, 381/400, 401, 403, 405, 409, 410; 977/742, 977/902, 949, 956, 932
See application file for complete search history.

(56) References Cited

U.S. PATENT DOCUMENTS 4,312,118 A 1/1982 Saik et al.
5,903,658 A * 5/1999 Okazaki et al. ..... 381/428
6,808,746 B1 10/2004 Dai et al.
7,045,108 B2 5/2006 Jiang et al.
7,437,938 B2 10/2008 Chakraborty
7,864,977 B2 * 1/2011 Sadaie et al. ..... 381/407
8,021,640 B2 * 9/2011 Kim et al. ..... 423/447.1
8,058,787 B2 * 11/2011 Ra et al. ..... 313/310
8,165,336 B2 * 4/2012 Iino et al. ..... 381/407
8,247,055 B2 * 8/2012 Jiang et al. ..... 428/40.1
2004/0020681 A1 2/2004 Hjortstam et al.
2004/0053780 A1 3/2004 Jiang et al.
2005/0079386 A1 * 4/2005 Brown et al. ..... 428/690
2005/0178516 A1 * 8/2005 Sekikawa et al. ..... 162/159
2006/0099419 A1 * 5/2006 Kwon et al. ..... 428/375
2007/0166223 A1 7/2007 Jiang et al.
2008/0248235 A1 10/2008 Feng et al.
2008/0297878 A1 * 12/2008 Brown et al. ..... 359/263

(Continued)

FOREIGN PATENT DOCUMENTS

CN 2282253 5/1998
CN 1270488 10/2000

(Continued)

OTHER PUBLICATIONS

Xiao et al.,Flexible, Stretchable, Transparent Carbon Nanotube Thin Film Loudspeakers,Nano Letters, vol. 8; No. 12, 4539-4545, Sep. 2008.

*Primary Examiner* — Edgardo San Martin
(74) *Attorney, Agent, or Firm* — Altis Law Group, Inc.

(57) ABSTRACT

A bobbin is a hollow tubular structure formed of a carbon nanotube composite structure. A loudspeaker includes a magnetic circuit; a bobbin; a voice coil; and a diaphragm. The magnetic circuit defines a magnetic gap. The bobbin is located in the magnetic gap. The voice coil is wounded on the bobbin. The diaphragm includes an inner rim fixed to the bobbin. The bobbin is a hollow tubular structure formed of a carbon nanotube composite structure.

19 Claims, 8 Drawing Sheets

U.S. PATENT DOCUMENTS

| | | | | |
|---|---|---|---|---|
| 2008/0299031 | A1 | 12/2008 | Liu et al. | |
| 2008/0304694 | A1 | 12/2008 | Hayashi | |
| 2009/0045005 | A1* | 2/2009 | Byon et al. | 181/167 |
| 2009/0068448 | A1 | 3/2009 | Liu et al. | |
| 2009/0074228 | A1* | 3/2009 | Mango et al. | 381/432 |
| 2009/0116681 | A1* | 5/2009 | Sadaie et al. | 381/401 |
| 2009/0153502 | A1 | 6/2009 | Jiang et al. | |
| 2009/0155467 | A1 | 6/2009 | Wang et al. | |
| 2009/0160799 | A1 | 6/2009 | Jiang et al. | |
| 2009/0197082 | A1 | 8/2009 | Jiang et al. | |
| 2009/0220767 | A1 | 9/2009 | Schlögl et al. | |
| 2009/0272935 | A1 | 11/2009 | Hata et al. | |
| 2010/0224354 | A1* | 9/2010 | Dooley et al. | 165/185 |
| 2010/0329501 | A1* | 12/2010 | Liu et al. | 381/407 |
| 2010/0329502 | A1* | 12/2010 | Liu et al. | 381/407 |
| 2011/0026750 | A1* | 2/2011 | Wang et al. | 381/335 |
| 2011/0038504 | A1* | 2/2011 | Liu et al. | 381/392 |
| 2011/0051984 | A1* | 3/2011 | Liu et al. | 381/394 |
| 2011/0064259 | A1* | 3/2011 | Liu et al. | 381/398 |
| 2011/0069860 | A1* | 3/2011 | Liu et al. | 381/413 |
| 2011/0075878 | A1* | 3/2011 | Liu et al. | 381/394 |
| 2011/0116677 | A1* | 5/2011 | Wang et al. | 381/400 |
| 2011/0139361 | A1* | 6/2011 | Liu et al. | 156/249 |

FOREIGN PATENT DOCUMENTS

| | | | |
|---|---|---|---|
| CN | 2488247 | | 4/2002 |
| CN | 1430785 | | 7/2003 |
| CN | 2583909 | | 10/2003 |
| CN | 1640923 | | 7/2005 |
| CN | 1982209 | A | 6/2007 |
| CN | 101239712 | | 8/2008 |
| CN | 101288336 | | 10/2008 |
| CN | 101288336 | A | 10/2008 |
| CN | 101304945 | | 11/2008 |
| CN | 101321410 | | 12/2008 |
| CN | 101381071 | | 3/2009 |
| CN | 101464759 | | 6/2009 |
| CN | 101497435 | A | 8/2009 |
| CN | 101499328 | | 8/2009 |
| JP | 60-27298 | | 2/1985 |
| JP | 63-49991 | | 12/1988 |
| JP | 7-138838 | | 5/1995 |
| JP | 2002-171593 | | 6/2002 |
| JP | 2002-542136 | | 12/2002 |
| JP | 2003-319490 | | 11/2003 |
| JP | 2004-32425 | | 1/2004 |
| JP | 2004-107196 | | 4/2004 |
| JP | 2006-147801 | | 6/2006 |
| JP | 2007-182352 | | 7/2007 |
| JP | 2007-290908 | | 11/2007 |
| JP | 2009-144158 | | 7/2009 |
| JP | 2009-146420 | | 7/2009 |
| JP | 2009-184910 | | 8/2009 |
| WO | WO2007015710 | | 2/2007 |

* cited by examiner

BOBBIN AND LOUDSPEAKER USING THE SAME

RELATED APPLICATIONS

This application claims all benefits accruing under 35 U.S.C. §119 from China Patent Application No. 200910108181.9, filed on Jun. 26, 2009 in the China Intellectual Property Office, the contents of which are hereby incorporated by reference. This application is related to commonly-assigned application entitled, "BOBBIN AND LOUDSPEAKER USING THE SAME", filed Jun. 28, 2010 Ser. No. 12/824,373.

BACKGROUND

1. Technical Field

The present disclosure relates to bobbins and speakers adopting the same.

2. Description of Related Art

Among the various types of loud speakers, electro-dynamic loudspeakers are most widely used because they have simple structures, good sound quality, and low costs. The electro-dynamic loudspeaker typically includes a diaphragm, a bobbin, a voice coil, a damper, a magnet, and a frame. The voice coil is an electrical conductor wrapped around the bobbin. The bobbin is connected to the diaphragm. The voice coil is placed in the magnetic field of the magnet.

To evaluate the quality of a loudspeaker, sound volume is a decisive factor. Sound volume of the loudspeaker relates to the input power of the electric signals and the conversion efficiency of the energy (e.g., the conversion efficiency of the electricity to sound). The larger the input power, the larger the conversion efficiency of the energy; the bigger the sound volume of the loudspeaker. However, when the input power is increased to certain levels, the bobbin and diaphragm could deform or even break, thereby causing audible distortion. Therefore, the strength and tensile modulus of the elements in the loudspeaker are decisive factors of a rated power of the loudspeaker. The rated power is the highest input power by which the loudspeaker can produce sound without the audible distortion. Additionally, the lighter the weight of the elements in the loudspeaker, such as the weight of the bobbin and the weight per unit area of the diaphragm; the smaller the energy required for causing the diaphragm to vibrate, the higher the energy conversion efficiency of the loudspeaker, and the higher the sound volume produced by the same input power. Thus, the strength, the tensile modulus, and the weight of the bobbin are important factors affecting the sound volume of the loudspeaker. The weight of the bobbin is related to a thickness and a density thereof. Accordingly, the higher the specific strength (e.g., strength-to-density ratio), the smaller the thickness of the bobbin of the loudspeaker, and the higher the sound volume of the loudspeaker.

However, the typical bobbin is usually made of paper, cloth, polymer, or composite material. The rated power of the conventional loudspeakers is difficult to increase partly due to the restriction of the conventional material of the bobbin. In general, the rated power of a small sized loudspeaker is only 0.3 watt (W) to 0.5 W. A thicker bobbin has a larger specific strength, but increases the weight of the bobbin. Thus, it is difficult to improve the energy conversion efficiency of the loudspeaker. To increase the rated power, the energy conversion efficiency of the loudspeaker, and sound volume, the focus is on increasing the specific strength and decreasing the weight of the bobbin.

What is needed, therefore, is to provide a bobbin with high specific strength and light weight, and a loudspeaker using the same.

BRIEF DESCRIPTION OF THE DRAWINGS

Many aspects of the present bobbin and loudspeaker using the same can be better understood with reference to the following drawings. The components in the drawings are not necessarily to scale, the emphasis instead being placed upon clearly illustrating the principles of the present bobbin and a loudspeaker using the same. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Reference will now be made to the drawings to describe, in detail, embodiments of a bobbin and a loudspeaker using the same.

Figure 1:
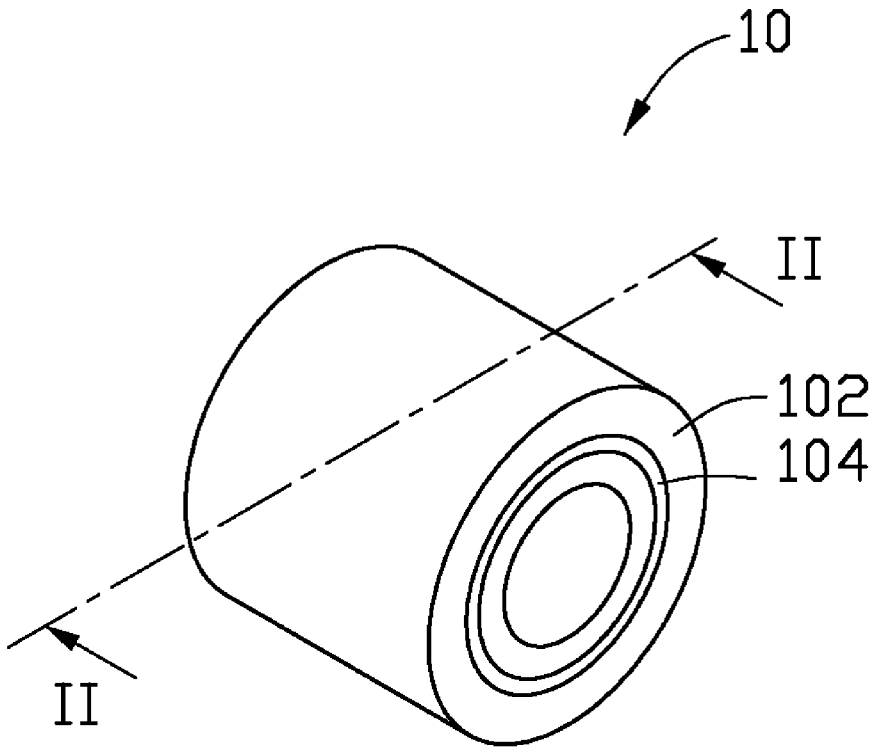
FIG. 1 is a schematic structural view of a first embodiment of a bobbin.
Figure 2:
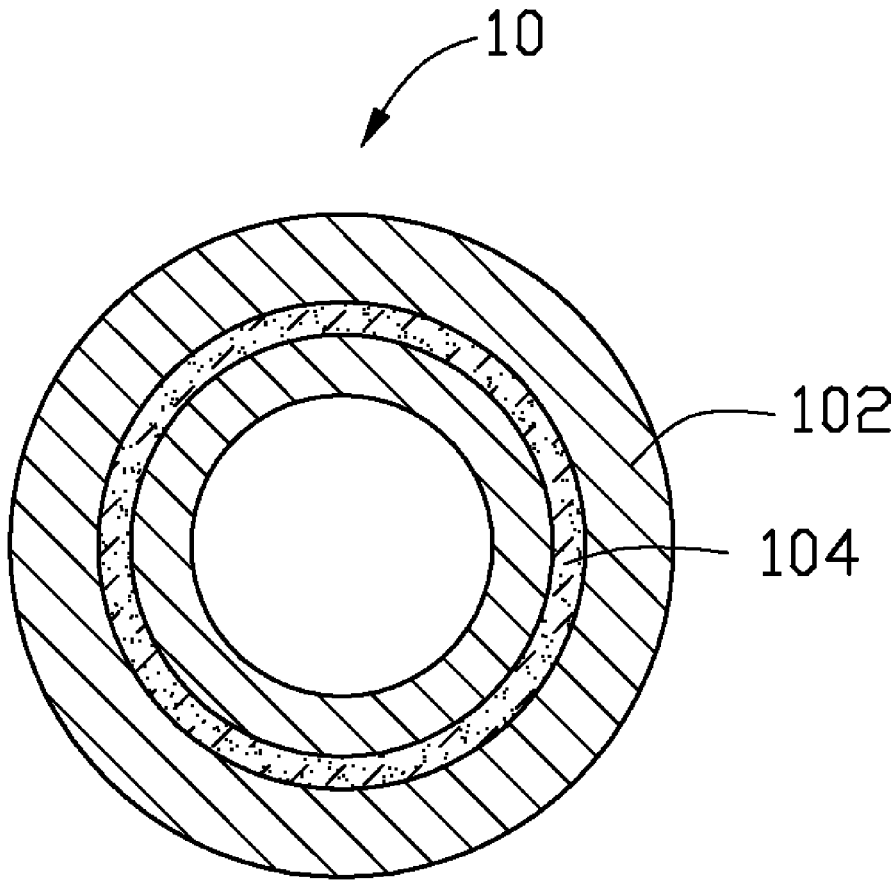
FIG. 2 is a cross-sectional view of the bobbin shown in FIG. 1.

A first embodiment of a bobbin 10 is shown in FIGS. 1 and 2. The bobbin 10 includes a carbon nanotube composite structure (not labeled). The carbon nanotube composite structure is formed by a carbon nanotube structure 104 composited with or in a matrix 102. The carbon nanotube structure 104 can be composited with the matrix 102 if the mass ratio of the carbon nanotube structure 104 in the bobbin 10 is high. The carbon nanotube structure 104 can also be composited in the matrix 102 if the mass ratio of the carbon nanotube structure 104 in the bobbin 10 is low. The bobbin 10 can be a hollow tubular structure formed of the carbon nanotube composite structure.

The matrix 102 is a hollow tubular structure. The matrix 102 can be made of polymers, paper, metal, or cloth. Specifically, the matrix 102 can be made of polyimide, polyester, aluminum, fiberglass or paper. The matrix 102 can have a light weight and a high specific strength. In one embodiment, the matrix 102 is a polyimide film. The polyimide film has a small density of about 1.35 g/cm$^3$, thus, it is conducive to decrease the weight of the bobbin 10, and increase the specific strength thereof.

The carbon nanotube structure 104 includes a plurality of carbon nanotubes. Interspaces are defined between the plurality of carbon nanotubes. A material of the matrix 102 can be filled in the interspaces. Alternatively, the matrix 102 can cover part or all of the carbon nanotubes. Further, the carbon nanotube structure 104 can also be located in the matrix 102. The carbon nanotube structure 104 includes at least one carbon nanotube film. Specifically, the carbon nanotube structure 104 includes a carbon nanotube film or a plurality of stacked carbon nanotube films.

The carbon nanotube film can be a freestanding film. The carbon nanotube film includes a plurality of carbon nanotubes distributed uniformly and attracted by van der Waals attractive force therebetween. The carbon nanotubes are orderly or disorderly aligned in the carbon nanotube film. The disorderly aligned carbon nanotubes are arranged along many different directions. The number of carbon nanotubes arranged along each different direction can be almost the same (e.g. uniformly disordered) and/or entangled with each other. The orderly aligned carbon nanotubes are arranged in a consistently systematic manner, e.g., most of the carbon nanotubes are arranged approximately along a same direction or have two or more sections within each of which the most of the carbon nanotubes are arranged approximately along a same direction (different sections can have different directions). The carbon nanotubes in the carbon nanotube film can be single-walled, double-walled, and/or multi-walled carbon nanotubes. The diameters of the single-walled carbon nanotubes can range from about 0.5 nanometers (nm) to about 50 nm. The diameters of the double-walled carbon nanotubes can range from about 1 nm to about 50 nm. The diameters of the multi-walled carbon nanotubes can range from about 1.5 nm to about 50 nm. Specifically, the carbon nanotube film can be a drawn carbon nanotube film, a flocculated carbon nanotube film, or a pressed carbon nanotube film. A mass ratio of the carbon nanotube structure 104 in the bobbin 10 can be larger than about 0.1%. In one embodiment, the mass ratio of the carbon nanotube structure 104 in the bobbin 10 can be larger than about 10%. The carbon nanotube structure 104 can strengthen the bobbin 10.

Figure 3:
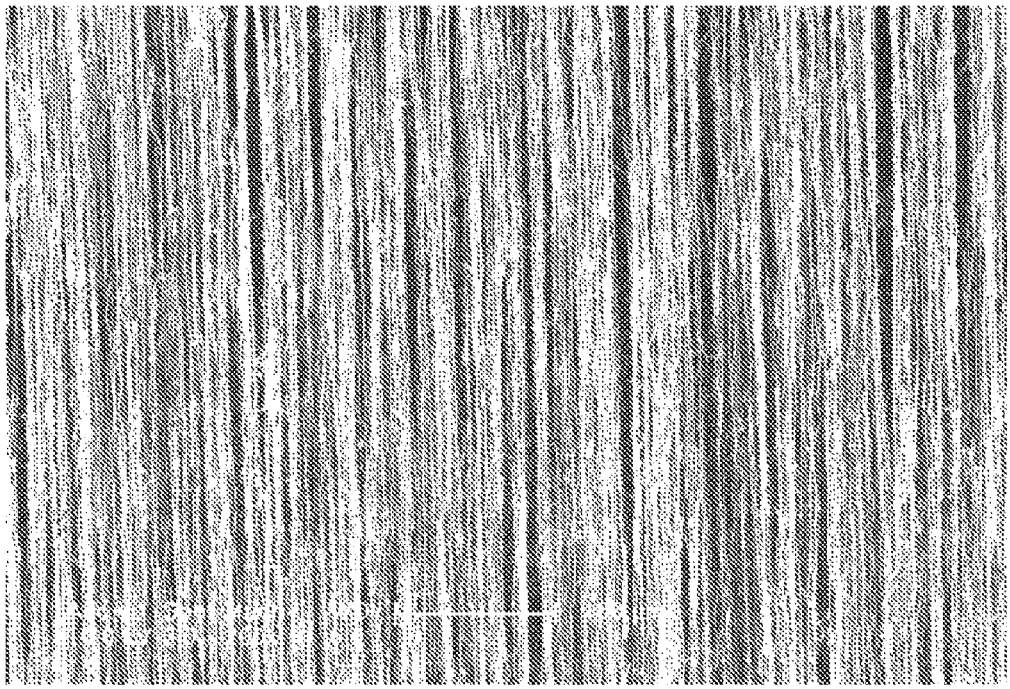
FIG. 3 shows a Scanning Electron Microscope (SEM) image of a drawn carbon nanotube film.

A film can be drawn from a carbon nanotube array, to obtain the drawn carbon nanotube film. Examples of the drawn carbon nanotube film are taught by U.S. Pat. No. 7,045,108 to Jiang et al., and WO 2007015710 to Zhang et al. The drawn carbon nanotube film includes a plurality of carbon nanotubes arranged substantially parallel to a surface of the drawn carbon nanotube film. A large number of the carbon nanotubes in the drawn carbon nanotube film can be oriented along a preferred orientation, meaning that a large number of the carbon nanotubes in the drawn carbon nanotube film are arranged substantially along the same direction. An end of one carbon nanotube is joined to another end of an adjacent carbon nanotube arranged substantially along the same direction, by van der Waals attractive force. The drawn carbon nanotube film is capable of forming a freestanding structure. The term "freestanding structure" includes, but is not limited to, a structure that does not have to be supported by a substrate. For example, the freestanding structure can sustain the weight of itself when it is hoisted by a portion thereof without any significant damage to its structural integrity. The successive carbon nanotubes joined end to end by van der Waals attractive force realizes the freestanding structure of the drawn carbon nanotube film. A SEM image of the drawn carbon nanotube film is shown in FIG. 3.

Some variations can occur in the orientation of the carbon nanotubes in the drawn carbon nanotube film. Microscopically, the carbon nanotubes oriented substantially along the same direction may not be perfectly aligned in a straight line, and some curve portions may exist. It can be understood that a contact between some carbon nanotubes located substantially side by side and oriented along the same direction can not be totally excluded.

More specifically, the drawn carbon nanotube film can include a plurality of successively oriented carbon nanotube segments joined end-to-end by van der Waals attractive force therebetween. Each carbon nanotube segment includes a plurality of carbon nanotubes substantially parallel to each other, and joined by van der Waals attractive force therebetween. The carbon nanotube segments can vary in width, thickness, uniformity, and shape. The carbon nanotubes in the drawn carbon nanotube film are also substantially oriented along a preferred orientation. A thickness of the drawn carbon nanotube film can range from about 0.5 nm to about 100 micrometer (μm). A width of the drawn carbon nanotube film relates to the carbon nanotube array from which the carbon nanotube film is drawn. If the carbon nanotube structure 104 includes the drawn carbon nanotube film and a thickness of the carbon nanotube structure 104 is relatively small (e.g., smaller than 10 μm), the carbon nanotube structure 104 can have a good transparency, and the transmittance of the light can reach to about 90%. The transparent carbon nanotube structure 104 can be used to make a transparent bobbin 10 with the transparent matrix 102.

The carbon nanotube structure 104 can include at least two stacked drawn carbon nanotube films. An angle between the aligned directions of the carbon nanotubes in two adjacent carbon nanotube films can range from about 0 degrees to about 90 degrees($0° \leqq \alpha \leqq 90°$). Spaces are defined between two adjacent and side-by-side carbon nanotubes in the drawn carbon nanotube film. If the angle between the aligned directions of the carbon nanotubes in adjacent carbon nanotube films is larger than 0 degrees, the carbon nanotubes define a microporous structure. The carbon nanotube structure 104 employing these films, define a plurality of micropores. A diameter of the micropores can be smaller than about 10 μm. Stacking the carbon nanotube films will add to the structural integrity of the carbon nanotube structure 104.

The flocculated carbon nanotube film can include a plurality of long, curved, disordered carbon nanotubes entangled with each other. A length of the carbon nanotubes can be larger than about 10 μm. In one embodiment, the length of the carbon nanotubes is in a range from about 200 μm to about 900 μm. Further, the flocculated carbon nanotube film can be isotropic. Adjacent carbon nanotubes are acted upon by van der Waals attractive force to obtain an entangled structure with micropores defined therein. The flocculated carbon nanotube film is very porous. The sizes of the micropores can be less than 10 μm. In one embodiment, sizes of the micropores are in a range from about 1 nm to about 10 μm. Further, because the carbon nanotubes in the carbon nanotube structure 104 are entangled with each other, the carbon nanotube structure 104 employing the flocculated carbon nanotube film has excellent durability, and can be fashioned into desired shapes with a low risk to the integrity of the carbon nanotube structure 104. The flocculated carbon nanotube film is freestanding because the carbon nanotubes are entangled and adhere together by van der Waals attractive force therebetween. The thickness of the flocculated carbon nanotube film can range from about 1 μm to about 1 millimeter (mm) In one embodiment, the thickness of the flocculated carbon nanotube film is about 100 μm.

The pressed carbon nanotube film can be a freestanding carbon nanotube film formed by pressing a carbon nanotube array on a substrate. The carbon nanotubes in the pressed carbon nanotube film are substantially arranged along a same direction or along different directions. The carbon nanotubes in the pressed carbon nanotube film can rest upon each other. Adjacent carbon nanotubes are attracted to each other and are combined by van der Waals attractive force. An angle between a primary alignment direction of the carbon nanotubes and a surface of the pressed carbon nanotube film is about 0 degrees to about 15 degrees. The greater the pressure applied, the smaller the angle obtained. If the carbon nanotubes in the pressed carbon nanotube film are arranged along different directions, the carbon nanotube structure 104 can be isotropic. Here, "isotropic" means the carbon nanotube film has properties identical in all directions substantially parallel to a surface of the carbon nanotube film. A thickness of the pressed carbon nanotube film ranges from about 0.5 nm to about 1 mm. A length of the carbon nanotubes can be larger than 50 μm. Clearances can exist in the carbon nanotube array. Therefore, micropores can exist in the pressed carbon nanotube film defined by the adjacent carbon nanotubes. An example of a pressed carbon nanotube film is taught by US PGPub. 20080299031A1 to Liu et al.

The matrix 102 and the carbon nanotube structure 104 can be combined depending on the specific material of the matrix 102. For example, when the material of the matrix 102 is a liquid polymer, the carbon nanotube structure 104 can be immersed in the liquid polymer until the liquid polymer soaks the carbon nanotube structure 104. The carbon nanotube structure 104 is then taken out and cured to form the carbon nanotube composite structure. If the material of the matrix 102 is a solid polymer, the matrix 102 can cover a surface of the carbon nanotube structure 104, and be combined with the carbon nanotube structure 104 via a hot pressing method. After cooling, the carbon nanotube composite material is formed. If the material of the matrix 102 is metal, the matrix 102 can be formed by depositing the material of the matrix 102 on the surface of the carbon nanotube structure 104 via physical vapor deposition method, chemical plating method, or electroplating deposition method, to composite with the carbon nanotube structure 104. The material of the matrix 102 can penetrate into the interspaces between the carbon nanotubes or cover the surface of the carbon nanotubes of the carbon nanotube structure 104 to form the carbon nanotube composite structure. In the carbon nanotube composite structure, the carbon nanotube structure 104 can be combined firmly with the matrix 102.

Before the carbon nanotube structure 104 is composited with the matrix 102, a deposition layer (not shown) can be deposited on the surface of the carbon nanotube structure 104. A material of the deposition layer can be metal, polymer, diamond, boron carbide, or ceramic. The metal can be at least one of iron (Fe), cobalt (Co), nickel (Ni), palladium (Pd), titanium (Ti), copper (Cu), silver (Ag), gold (Au), platinum (Pt), or combinations thereof. The deposition layer can make the matrix 102 and the carbon nanotube structure 104 combine more firmly. The deposition layer can be formed by a coating method or a depositing method. Specifically, the deposition layer can be formed by a method such as PVD, CVD, electroplating, or chemical plating. In one embodiment, the material of the deposition layer can be wet, or be compatible with both the carbon nanotubes of the carbon nanotube structure 104 and the matrix 102, so that the carbon nanotube structure 104 and the matrix 102 can be firmly combined by the deposition layer. If the material of the matrix 102 is metal, the material of the deposition layer can be the same as that of the matrix 102 or have good compatibility with both the matrix 102 and the carbon nanotube structure 104, so that the matrix 102 and the carbon nanotube structure 104 could be combined more firmly.

If the matrix 102 and the carbon nanotube structure 104 are combined by the hot pressing method, the matrix 102 and the carbon nanotube structure 104 can be placed in a hot-press machine and pressed at a predetermined temperature, e.g., a temperature being about the melting temperature of the matrix 102. In one embodiment, the matrix 102 and the carbon nanotube structure 104 can be combined by the adhesive and then hot pressed by the hot pressing method to acquire a more solid combination.

If the carbon nanotube structure 104 and the matrix 102 are combined by the hot pressing method, the matrix 102 and the carbon nanotube structure 104 can be placed in a hot-press machine and pressed at a predetermined temperature, e.g., a temperature higher than the glass transition temperature and lower than the melting temperature under a certain pressure. The pressure can be in a range from about 0.3 to about 1 MPa.

It is noteworthy that methods for making the bobbin 10 are not limited. The bobbin 10 can be made by the following two methods. The first method can include the following steps of:

supplying a column having a surface;

preparing a composite structure formed by the matrix 102 and the carbon nanotube structure 104 composited therein; and wrapping the composite structure on the surface of the column, and adhering the composite structure at the joint portion between the composite structure and the column firmly to form the bobbin 10.

The second method can include the following steps of:

supplying a column having a surface, at least one carbon nanotube structure 104, and a matrix 102;

directly wrapping the carbon nanotube structure 104 on the surface of the column; and combining or compositing the carbon nanotube structure 104 with the matrix 102 firmly to form the bobbin 10.

In one embodiment, the material of the matrix 102 is polyimide, and the carbon nanotube structure 104 is located in the matrix 102. The carbon nanotube structure 104 includes two layers of carbon nanotube drawn films, and the angle between the aligned directions of the carbon nanotubes in the two adjacent carbon nanotube films is about 90 degrees. The carbon nanotube structure 104 formed by the carbon nanotube drawn films stacked with each other and having an angle between the aligned directions of the carbon nanotubes in two adjacent carbon nanotube films above 0 degrees to about 90 degrees, has an excellent mechanical strength.

Because the carbon nanotube structure 104 has excellent mechanical strength and a low density, the bobbin 10 adopting the carbon nanotube structure 104 can also have a high specific strength and/or a lighter weight.

Figure 4:
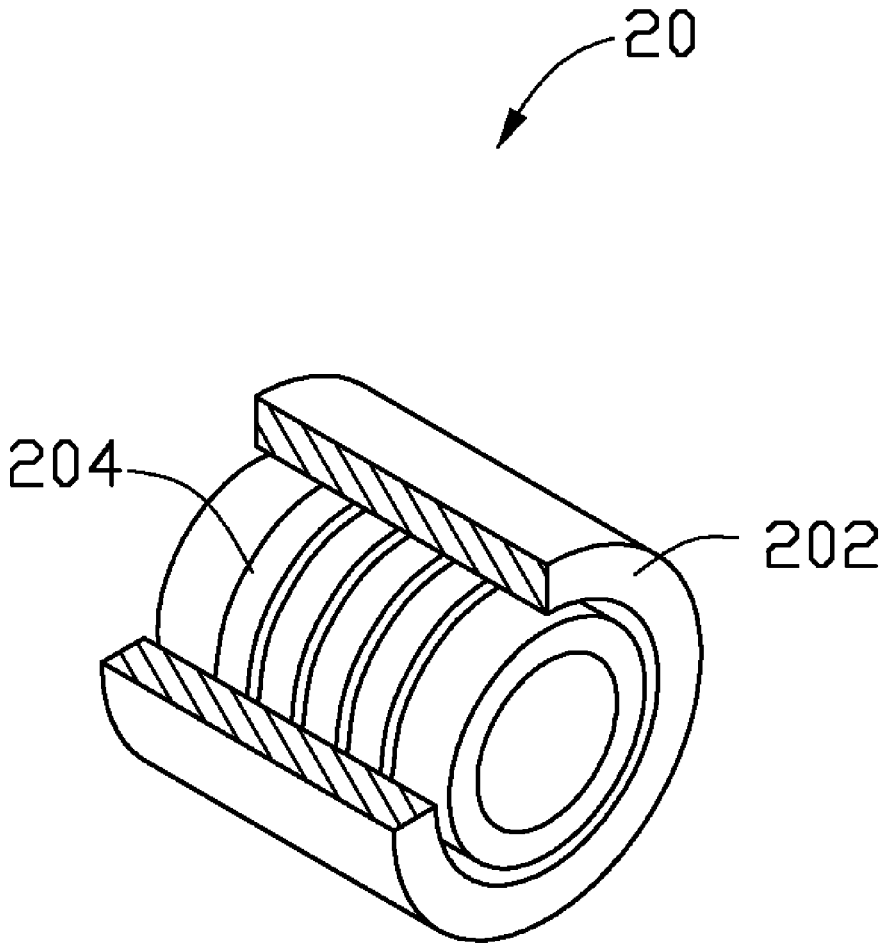
FIG. 4 is a cross-sectional view of a second embodiment of a bobbin.

A second embodiment of a bobbin 20 is illustrated in FIG. 4. The bobbin 20 includes a carbon nanotube composite structure formed by a matrix 202 and a carbon nanotube structure 204 composited with or in the matrix 202. The bobbin 20 can have a hollow tubular structure formed of the carbon nanotube composite structure. The carbon nanotube structure 204 includes a carbon nanotube wire structure.

The compositions, features, and functions of the bobbin 20 in the embodiment shown in FIG. 4 are similar to the bobbin 10 in the embodiment shown in FIG. 1, except that the present carbon nanotube structure 204 includes a carbon nanotube wire structure. The carbon nanotube wire structure is located in the matrix 202 like a helix. A diameter of the carbon nanotube wire structure can be in a range from about 0.5 nm to about 1 mm.

The carbon nanotube wire structure includes at least one carbon nanotube wire. If the carbon nanotube wire structure includes a plurality of carbon nanotube wires, the carbon nanotube wires can be substantially parallel to each other to form a bundle-like structure or twisted with each other to form a twisted structure. The bundle-like structure and the twisted structure are two kinds of linear shaped carbon nanotube structure.

The carbon nanotube wire can be untwisted or twisted. Treating the drawn carbon nanotube film with a volatile organic solvent can obtain the untwisted carbon nanotube wire. In one embodiment, the organic solvent is applied to soak the entire surface of the drawn carbon nanotube film. During soaking, adjacent parallel carbon nanotubes in the drawn carbon nanotube film will bundle together, due to the surface tension of the organic solvent as it volatilizes, and thus, the drawn carbon nanotube film will be shrunk into an untwisted carbon nanotube wire. The untwisted carbon nanotube wire includes a plurality of carbon nanotubes substantially oriented along a same direction (i.e., a direction along the length direction of the untwisted carbon nanotube wire). The carbon nanotubes are substantially parallel to the axis of the untwisted carbon nanotube wire. In one embodiment, the untwisted carbon nanotube wire includes a plurality of successive carbon nanotubes joined end to end by van der Waals attractive force therebetween. The length of the untwisted carbon nanotube wire can be arbitrarily set as desired. A diameter of the untwisted carbon nanotube wire can range from about 0.5 nm to about 100 μm. An example of the untwisted carbon nanotube wire is taught by US Patent Application Publication US 2007/0166223 to Jiang et al.

The twisted carbon nanotube wire can be obtained by twisting a drawn carbon nanotube film using a mechanical force to turn the two ends of the drawn carbon nanotube film in opposite directions. The twisted carbon nanotube wire includes a plurality of carbon nanotubes helically oriented around an axial direction of the twisted carbon nanotube wire. In one embodiment, the twisted carbon nanotube wire includes a plurality of successive carbon nanotubes joined end to end by van der Waals attractive force therebetween. The length of the carbon nanotube wire can be set as desired. A diameter of the twisted carbon nanotube wire can be from about 0.5 nm to about 100 μm.

The carbon nanotube wire is a freestanding structure. The carbon nanotube wire has a high strength and tensile modulus. Therefore, by arranging the carbon nanotube wire to set the carbon nanotube wire located in the matrix 202, the strength and tensile modulus of the bobbin 20 can be improved.

It is noteworthy that the carbon nanotube structure 204 can also include a carbon nanotube hybrid wire structure (not shown). The carbon nanotube hybrid wire structure can include a bundle-like structure formed by the at least one carbon nanotube wire and at least one base wire substantially parallel to each other, or a twisted structure formed by the at least one carbon nanotube wire and the at least one base wire twisted with each other. A material of the base wire can be the same as that of the matrix 202. The base wire can have an excellent specific strength and a low density. Further, the base wire also can have a good high temperature resistance property. In one embodiment, the base wire can be resistant to a temperature about 250° C.

The method for making the bobbin 20 is similar to that of the bobbin 10. The carbon nanotube wire structure can be composited with the matrix 202 to form a carbon nanotube composite wire structure, and then wrapped around a column Because the carbon nanotube composite wire structure has a free-standing structure, after the column is removed, the bobbin 20 is formed.

Figure 5:
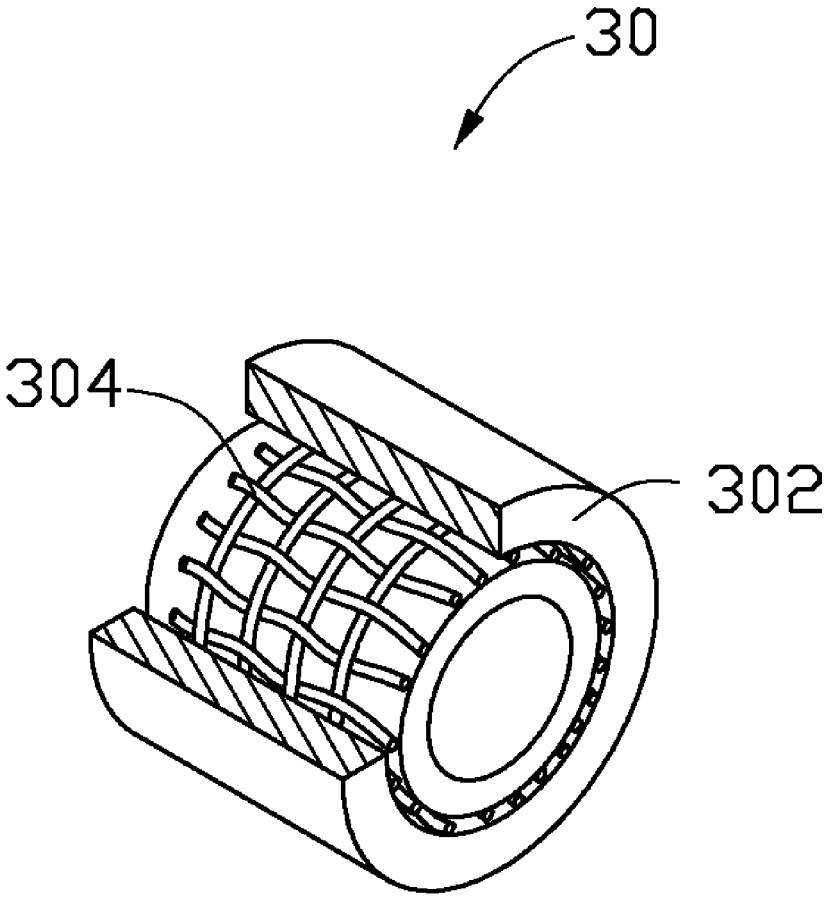
FIG. 5 is a cross-sectional view of a third embodiment of a bobbin.

A third embodiment of a bobbin 30 is illustrated in FIG. 5. The bobbin 30 includes a carbon nanotube composite structure formed by a matrix 302 and a carbon nanotube structure 304 composited with or in the matrix 302. The bobbin 30 is a hollow tubular structure formed of the carbon nanotube composite structure. The carbon nanotube structure 304 includes a plurality of carbon nanotube wire structures.

The compositions, features and functions of the bobbin 30 in the third embodiment shown in FIG. 5 are similar to the bobbin 20 in the second embodiment shown in FIG. 4, except that the present carbon nanotube structure 304 includes a plurality of carbon nanotube wire structures. The plurality of carbon nanotube wire structures can be substantially parallel to each other, crossed with each other or woven together and positioned in the matrix 302. In one embodiment, the material of the matrix 302 can be filled in the interspaces between the carbon nanotubes of the carbon nanotube wire structure, or the interspaces between the carbon nanotube wire structures, or cover at least part of the carbon nanotubes of the carbon nanotube wire structure. The plurality of carbon nanotube wire structures can be substantially parallel to each other, crossed with each other or woven together to form a planar shaped structure, and the planar shaped structure can then be composited with the matrix 302.

The plurality of carbon nanotube wire structures can also be woven together with the at least one base wire of the second embodiment. The plurality of carbon nanotube wire structures and the at least one base wire, which can be substantially parallel to each other, crossed with each other, or woven together, are placed in and composited with the matrix 302.

Figure 6:
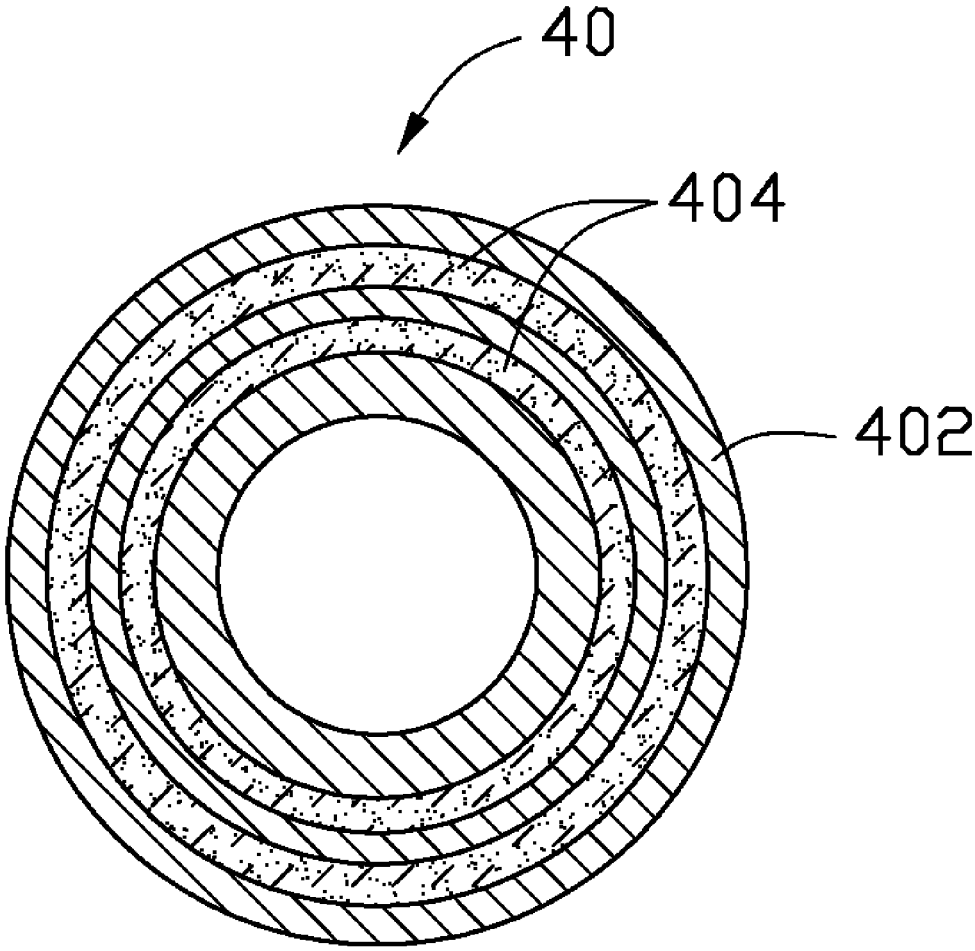
FIG. 6 is a cross-sectional view of a fourth embodiment of a bobbin.

A fourth embodiment of a bobbin 40 is illustrated in FIG. 6. The bobbin 40 includes a carbon nanotube composite structure formed by a matrix 402 and at least two carbon nanotube structures 404 composited in the matrix 402. The bobbin 40 has a hollow tubular structure formed of the carbon nanotube composite structure.

The compositions, features and functions of the bobbin 40 in the embodiment shown in FIG. 6 are similar to the bobbin 10 in the embodiment shown in FIG. 1, except that the present carbon nanotube structure 404 includes at least two carbon nanotube wire structures. The at least two carbon nanotube wire structures can be spaced from each other or located intimately (e.g., without any spaces between the two carbon nanotube wire structures). Specifically, the at least two carbon nanotube structures 404 can be stacked with each other, coplanar with each other, or substantially parallel to each other, and located in the matrix 402. It is noteworthy that the carbon nanotube structure 404 can be the at least one carbon nanotube film shown in the first embodiment, the carbon nanotube wire structure of the second embodiment, the plurality of carbon nanotube wire structures of the third embodiment, or any combination thereof. The matrix 402 can be composited with the two carbon nanotube structures 404 one by one, or all at once. In one embodiment, when the bobbin 40 includes two spaced carbon nanotube structures 404 and the matrix 402 is a liquid polymer, the two carbon nanotube structures 404 can be placed in the liquid polymer. After soaking the two carbon nanotube structures in the liquid polymer, the liquid polymer is cured, thereby forming the carbon nanotube composite structure. Furthermore, pressure can be also applied to the carbon nanotube structure 404 and the liquid polymer to remove gas between the carbon nanotubes of the carbon nanotube structure 404, thereby making the liquid polymer infiltrate interspaces between the carbon nanotubes of the carbon nanotube structures 404.

In one embodiment, the bobbin 40 includes two carbon nanotube structures 404. The two carbon nanotube structures 404 are composited in the matrix 402 at a certain distance.

Figure 7:
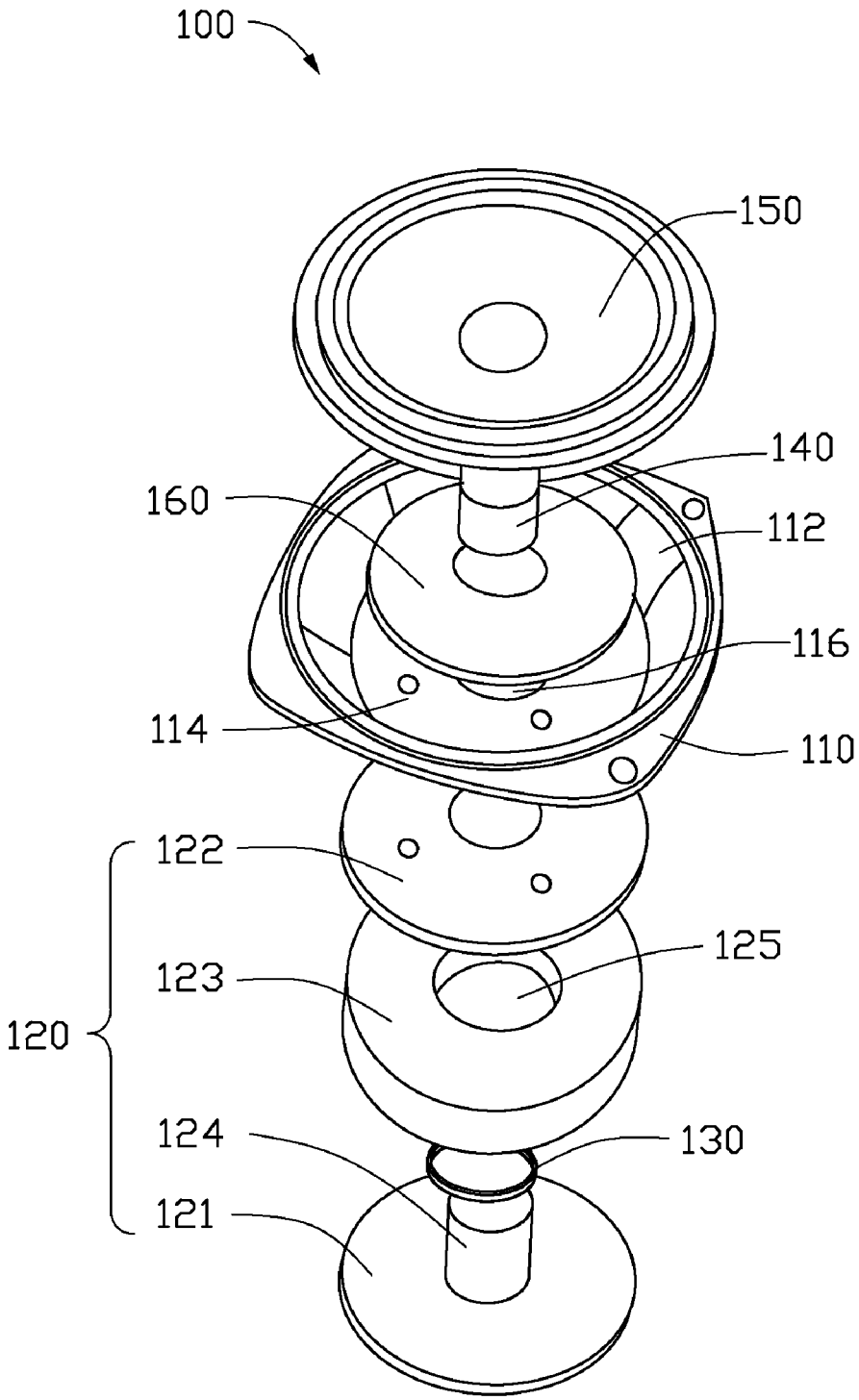
FIG. 7 is a schematic structural view of one embodiment of a loudspeaker using the bobbin.
Figure 8:
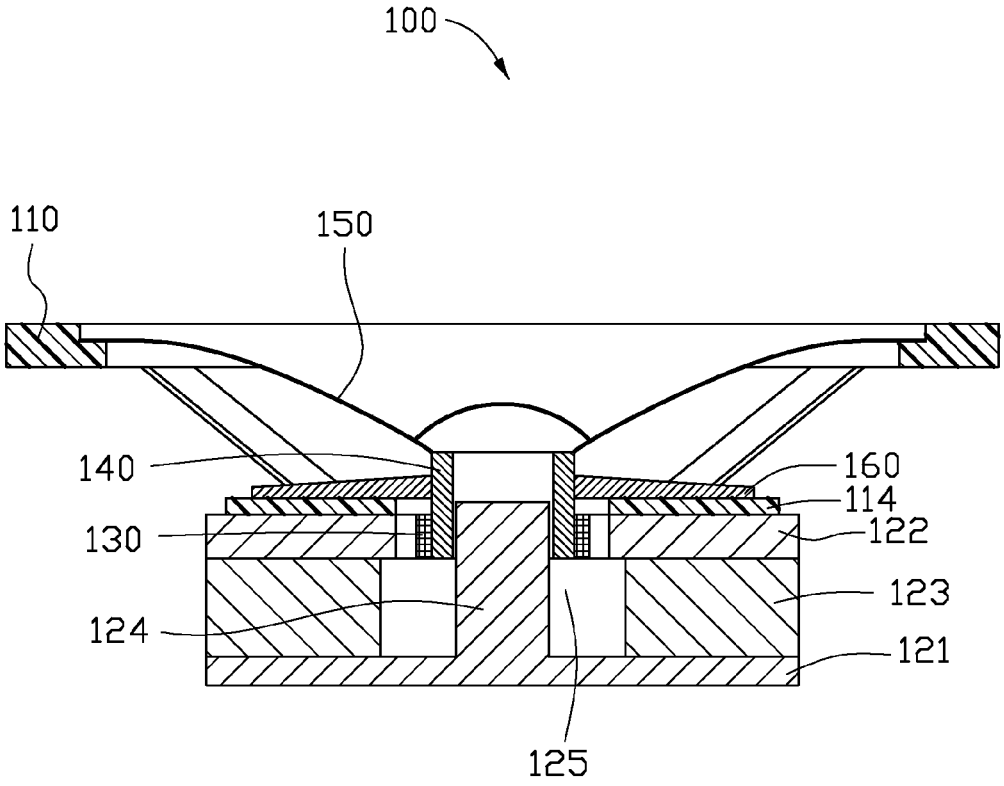
FIG. 8 is a cross-sectional view of one embodiment of the loudspeaker of FIG. 7.

One embodiment of a loudspeaker 100 using a bobbin 140 is illustrated in FIGS. 7 and 8. The bobbin 140 can be any of the aforementioned embodiments. The loudspeaker 100 includes a frame 110, a magnetic system 120, a voice coil 130, the bobbin 140, a diaphragm 150, and a damper 160.

The frame 110 is mounted on an upper side of the magnetic system 120. The voice coil 130 is received in the magnetic system 120. The voice coil 130 winds up on the bobbin 140. An outer rim of the diaphragm 150 is fixed to an inner rim of the frame 110, and an inner rim of the diaphragm 150 is fixed to an outer rim of the bobbin 140 placed in a magnetic gap 125 of the magnetic system 120.

The frame 110 is a truncated cone with an opening on one end and includes a hollow cavity 112 and a bottom 114. The hollow cavity 112 receives the diaphragm 150 and the damper 160. The bottom 114 has a center hole 116 to accommodate the center pole 116 of the magnetic system 120. The bottom 114 of the frame 110 is fixed to the magnetic system 120.

The magnetic system 120 includes a lower plate 121 having a center pole 124, an upper plate 122, and a magnet 123. The magnet 123 is sandwiched by the lower plate 121 and the upper plate 122. The upper plate 122 and the magnet 123 are both circular, and define a cylinder shaped space in the magnet circuit 120. The center pole 124 is accepted in the cylinder shaped space and goes through the center pole 124. The magnetic gap 125 is formed by the center pole 124 and the magnet 123. The magnetic system 120 is fixed on the bottom 114 at the upper plate 122.

The voice coil 130 wound on the bobbin 140 is a driving member of the loudspeaker 100. The voice coil 130 is made of conducting wire. When the electric signal is input into the voice coil 130, a magnetic field can be formed by the voice coil 130 as the variation of the electric signal. The interaction of the magnetic field caused by the voice coil 130 and the magnetic system 120 produces the vibration of the voice coil 130.

The bobbin 140 is light in weight and has a hollow structure. The bobbin 140 can be the bobbin 10 shown in FIG. 1, the bobbin 20 shown in FIG. 4, the bobbin 30 shown in FIG. 5, or the bobbin 40 shown in FIG. 6. The center pole 124 is positioned in the hollow structure and spaced from the bobbin 140. When the voice coil 130 vibrates, the bobbin 140 and the diaphragm 150 also vibrate with the voice coil 130 to produce sound.

The diaphragm 150 is a sound producing member of the loudspeaker 40. The diaphragm 150 can have a cone shape when used in a large sized loudspeaker 40. If the loudspeaker 100 is a smaller size, the diaphragm 150 can have a planar round shape or a planar rectangle shape.

The damper 160 is a substantially ring-shaped plate having radially alternating circular ridges and circular furrows. The damper 160 holds the diaphragm 150 mechanically. The damper 160 is fixed to the frame 110 and the bobbin 140. The damper 160 has a relatively large rigidity along the radial direction thereof, and a relatively small rigidity along the axial direction thereof, such that the voice coil can freely move up and down but not radially.

Furthermore, an external input terminal can be attached to the frame 110. A dust cap can be fixed over and above a joint portion of the diaphragm 150 and the bobbin 140.

Finally, it is to be understood that the above-described embodiments are intended to illustrate rather than limit the disclosure. Variations may be made to the embodiments without departing from the spirit of the disclosure as claimed. Elements associated with any of the above embodiments are envisioned to be associated with any other embodiments. The above-described embodiments illustrate the scope of the disclosure but do not restrict the scope of the disclosure.

What is claimed is:

1. A bobbin comprising a carbon nanotube composite structure, wherein the carbon nanotube composite structure comprises a matrix and at least one carbon nanotube structure composited with or in the matrix, and the at least one carbon nanotube structure comprises a plurality of carbon nanotubes attracted by van der Waals attractive force therebetween.

2. The bobbin of claim 1, wherein the carbon nanotube composite structure comprises a plurality of carbon nanotube structures spaced from each other.

3. The bobbin of claim 1, wherein the at least one carbon nanotube structure comprises at least one carbon nanotube film, at least one carbon nanotube wire structure, or a combination thereof.

4. The bobbin of claim 3, wherein the at least one carbon nanotube film comprises a plurality of carbon nanotubes distributed uniformly therein.

5. The bobbin of claim 3, wherein the at least one carbon nanotube structure comprises two or more stacked carbon nanotube films.

6. The bobbin of claim 3, wherein the at least one carbon nanotube film comprises a plurality of carbon nanotubes substantially parallel to a surface of the carbon nanotube film, the plurality of the carbon nanotubes being joined end-to-end by van der Waals attractive force therebetween and substantially aligned along a same direction.

7. The bobbin of claim 3, wherein the at least one carbon nanotube structure comprises a plurality of carbon nanotube wire structures substantially parallel to each other, crossed with each other, or woven together.

8. The bobbin of claim 3, wherein the at least one carbon nanotube wire structure comprises at least one twisted carbon nanotube wire, at least one untwisted carbon nanotube wire, or a combination of the at least one twisted carbon nanotube wire and the at least one untwisted carbon nanotube wire.

9. The bobbin of claim 8, wherein the at least one carbon nanotube wire structure comprises a plurality of carbon nanotube wires substantially parallel to each other to form a bundle structure or twisted with each other to form a twisted structure.

10. The bobbin of claim 1, wherein a material of the matrix is selected from the group consisting of polymers, paper, metal, and cloth.

11. The bobbin of claim 1, wherein a mass ratio of the at least one carbon nanotube structure is larger than about 0.1%.

12. A bobbin, comprising a hollow tubular structure comprising a plurality of carbon nanotubes attracted by van der Waals attractive force therebetween, the plurality of carbon nanotubes defining a plurality of interspaces; and a matrix infiltrating into the interspaces.

13. The bobbin of claim 12, wherein the matrix covers each of the plurality of carbon nanotubes.

14. A loudspeaker, comprising:

a magnetic circuit defining a magnetic gap;

a bobbin located in the magnetic gap;

a voice coil wounded on the bobbin; and a diaphragm comprising an inner rim fixed to the bobbin, wherein the bobbin is a hollow tubular structure comprising a carbon nanotube composite structure, the carbon nanotube composite structure comprises a matrix and at least one carbon nanotube structure composited with or in the matrix, and the at least one carbon nanotube structure comprises a plurality of carbon nanotubes attracted by van der Waals attractive force therebetween.

15. The loudspeaker of claim 14, wherein the carbon nanotube composite structure comprises a matrix and at least one carbon nanotube structure composited with the matrix.

16. The loudspeaker of claim 15, wherein the at least one carbon nanotube structure comprises at least one carbon nanotube film comprising a plurality of carbon nanotubes distributed uniformly therein.

17. The loudspeaker of claim 14, wherein the carbon nanotube composite structure comprises a matrix and at least two ring-shape carbon nanotube structures disposed in the matrix.

18. The loudspeaker of claim 17, wherein the at least two carbon nanotube structures are concentric with each other.

19. The loudspeaker of claim 18, wherein the at least two carbon nanotube structures are spaced from each other.

* * * * *